US007848688B2

(12) United States Patent
Murayama

(10) Patent No.: US 7,848,688 B2
(45) Date of Patent: Dec. 7, 2010

(54) IMAGE-FORMING DEVICE

(75) Inventor: Kentaro Murayama, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 244 days.

(21) Appl. No.: 12/056,806

(22) Filed: Mar. 27, 2008

(65) Prior Publication Data

US 2008/0240798 A1 Oct. 2, 2008

(30) Foreign Application Priority Data

Mar. 29, 2007 (JP) ..... 2007-086748

(51) Int. Cl.
*G03G 15/01* (2006.01)

(52) U.S. Cl. ..... 399/301

(58) Field of Classification Search ..... 399/297–302, 399/306, 308

See application file for complete search history.

(56) References Cited

U.S. PATENT DOCUMENTS

| | | | | |
|---|---|---|---|---|
| 5,740,492 | A * | 4/1998 | Deki et al. | 399/66 |
| 5,875,380 | A * | 2/1999 | Iwata et al. | 399/301 |
| 6,909,516 | B1 * | 6/2005 | Hoover | 356/615 |
| 6,920,303 | B2 | 7/2005 | Yamanaka et al. | |
| 2003/0214568 | A1 * | 11/2003 | Nishikawa et al. | 347/116 |
| 2005/0104950 | A1 * | 5/2005 | Eom | 347/116 |
| 2006/0176355 | A1 * | 8/2006 | An | 347/116 |
| 2006/0177246 | A1 * | 8/2006 | Kawada et al. | 399/301 |
| 2007/0059053 | A1 * | 3/2007 | Namba | 399/301 |

FOREIGN PATENT DOCUMENTS

| | | |
|---|---|---|
| JP | 09-193476 | 7/1997 |
| JP | 2001-005246 | 1/2001 |
| JP | 2002-357942 | 12/2002 |
| JP | 2004-012549 | 1/2004 |
| JP | 2006-058448 | 3/2006 |

OTHER PUBLICATIONS

Japanese Office Action- Application No. 2007-086748 Reference No. 2006-04289 Mailing Date Jan. 23, 2009.

* cited by examiner

*Primary Examiner*—David P Porta
*Assistant Examiner*—Kiho Kim
(74) *Attorney, Agent, or Firm*—Banner & Witcoff, LTD

(57) ABSTRACT

An image-forming device includes 1st to Mth photosensitive drums (which are arrayed in numeric order in a first direction), a forming unit, an image-carrying member, a detecting unit, and a calibrating unit. Each of the photosensitive drums has a circumferential length D and extends in a first direction. The forming unit forms a registration mark on each of the photosensitive drums. The registration marks are transferred onto the image-carrying member in the numeric order and are arrayed in the first direction. Neighboring registration marks are spaced by a distance L in the first direction. The detecting unit detects positions of the registration marks. The calibrating unit calibrates positions of the photosensitive drums based on the positions detected by the detecting unit. D=NxMxL+(M−1)xL. N being an integer not less than 0.

8 Claims, 7 Drawing Sheets

IMAGE-FORMING DEVICE

CROSS REFERENCE TO RELATED APPLICATION

This application claims priority from Japanese Patent Application No. 2007-086748 filed Mar. 29, 2007. The entire content of each of these priority applications is incorporated herein by reference.

TECHNICAL FIELD

The present invention relates to an image-forming device.

BACKGROUND

In an image-forming device, sometimes the positions of images formed on the recording medium can become shifted from their correct positions when the body of the image-forming device receives an impact, for example. For this reason, some conventional image-forming devices have been provided with a function to correct offset in the image-forming positions. This type of image-forming device transfers marks formed on photosensitive members for detecting registration error onto a conveying belt that is driven to convey the recording medium, detects the positions of the marks with a photosensor or the like, and corrects the positions of images formed on the photosensitive members based on the detection results. Accordingly, the image-forming device can form high-quality images with a reduction in registration error.

Japanese unexamined patent application publication No. HEI-9-193476 describes an image-forming device that forms a plurality of marks for detecting registration error, each mark configured of a set of four colors, where the writing positions of the marks are set to positions of opposite phase relative to the rotational period of the photosensitive member. This construction is designed to prevent dynamic positional offset caused by rotational irregularities of the photosensitive member from adversely affecting the accuracy in correcting registration error.

SUMMARY

However, in an electrophotographic image-forming device, foreign matter, scratches, or the like on the surface of the photosensitive member can sometimes produce unintended images, such as black spots or other blemishes, in non-image-forming positions every rotational period of the photosensitive member (at intervals equivalent to the circumference of the photosensitive member). Consequently, these blemishes can interfere with marks used for detecting registration error (the blemish being mistakenly recognized as a mark), depending on the positions of the blemishes, reducing the accuracy for detecting the positions of marks.

Since these blemishes are formed every rotational period of the photosensitive member, the sensor for detecting marks used to correct registration error may misinterpret blemishes as marks each time a blemish arrives in the detecting position. This is a particular problem in Japanese unexamined patent application publication No. HEI-9-193476, which forms marks based on the rotational period of the photosensitive member, because marks of the same color are formed at each rotational period of the photosensitive member. Accordingly, only marks of that color are affected by blemishes being misinterpreted as marks, dramatically worsening the position detecting accuracy for that color compared to the accuracy for detection positions of the other marks and, therefore, making it difficult to appropriately correct registration error.

In view of the foregoing, it is an object of the present invention to provide an image-forming device capable of suppressing a dramatic drop in the accuracy for correcting registration error, even when blemishes are formed at every rotational period of the photosensitive member.

In order to attain the above and other objects, the present invention provides an image-forming device including 1st to Mth photosensitive drums, a forming unit, an image-carrying member, a detecting unit, and a calibrating unit. The 1st to Mth photosensitive drums are arrayed in numeric order in a first direction. Each of the photosensitive drums is rotatable and has a circumferential length D. M is an integer no less than 1. The forming unit forms a registration mark on each of the photosensitive drums. Each of the registration marks formed on each of the photosensitive drums has a color different from one another. The image-carrying member extends in the first direction. The registration marks formed on the photosensitive drums are transferred onto the image-carrying member in the numeric order. The registration marks transferred onto the image-carrying member are arrayed in the first direction. Neighboring registration marks are spaced by a distance L in the first direction. The detecting unit detects positions of the registration marks transferred onto the image-carrying member. The calibrating unit calibrates positions of the photosensitive drums at which the forming unit forms the registration marks, based on the positions detected by the detecting unit. $D=N\times M\times L+(M-1)\times L$, N being an integer no less than 0.

Another aspect of the present invention provides an image-forming device including 1st to Mth photosensitive drums, a forming unit, an image-carrying member, a detecting unit, and a calibrating unit. The 1st to Mth photosensitive drums are arrayed in numeric order in a first direction. Each of the photosensitive drums is rotatable and has a circumferential length D. M is an integer no less than 1. The forming unit forms a registration mark on each of the photosensitive drums. Each of the registration marks formed on each of the photosensitive drums has a color different from one another. The image-carrying member extends in the first direction. The registration marks formed on the photosensitive drums are transferred onto the image-carrying member in the numeric order. The registration marks transferred onto the image-carrying member are arrayed in the first direction. Neighboring registration marks are spaced by a distance L in the first direction. The detecting unit detects positions of the registration marks transferred onto the image-carrying member. The calibrating unit calibrates positions of the photosensitive drums at which the forming unit forms the registration marks, based on the positions detected by the detecting unit. $D=N\times M\times L+L$, N being an integer no less than 0.

Another aspect of the present invention provides an image-forming device including 1st to Mth photosensitive drums, a forming unit, an image-carrying member, a detecting unit, and a calibrating unit. The 1st to Mth photosensitive drums are arrayed in numeric order in a first direction. Each of the photosensitive drums is rotatable and has a circumferential length D. M is an integer no less than 4. The forming unit forms a registration mark on each of the photosensitive drums. Each of the registration marks formed on each of the photosensitive drums has a color different from one another. The image-carrying member extends in the first direction. The registration marks formed on the photosensitive drums are transferred onto the image-carrying member in the numeric order. The registration marks transferred onto the image-carrying member are arrayed in the first direction.

Neighboring registration marks are spaced by a distance L in the first direction. The detecting unit detects positions of the registration marks transferred onto the image-carrying member. The calibrating unit calibrates positions of the photosensitive drums at which the forming unit forms the registration marks, based on the positions detected by the detecting unit. $D=N\times M\times L+(M-R)\times L$, N is an integer no less than 0, R being a positive integer (such that $M>2R$ and $M\neq IR$ (where I is an integer)).

Another aspect of the present invention provides an image-forming device including 1st to Mth photosensitive drums, a forming unit, an image-carrying member, a detecting unit, and a calibrating unit. The 1st to Mth photosensitive drums are arrayed in numeric order in a first direction. Each of the photosensitive drums is rotatable and has a circumferential length D. M is an integer no less than 4. The forming unit forms a registration mark on each of the photosensitive drums. Each of the registration marks formed on each of the photosensitive drums has a color different from one another. The image-carrying member extends in the first direction. The registration marks formed on the photosensitive drums are transferred onto the image-carrying member in the numeric order. The registration marks transferred onto the image-carrying member are arrayed in the first direction. Neighboring registration marks are spaced by a distance L in the first direction. The detecting unit detects positions of the registration marks transferred onto the image-carrying member. The calibrating unit calibrates positions of the photosensitive drums at which the forming unit forms the registration marks, based on the positions detected by the detecting unit. $D=N\times M\times L+R\times L$, N is an integer no less than 0, R being a positive integer (such that $M>2R$ and $M\neq IR$ (where I is an integer)).

BRIEF DESCRIPTION OF THE DRAWINGS

The particular features and advantages of the invention as well as other objects will become apparent from the following description taken in connection with the accompanying drawings, in which.

DETAILED DESCRIPTION

First Embodiment

A first embodiment of the present invention will be described with reference to FIGS. 1-4.

(The Entire Configuration of a Printer)

Figure 1:
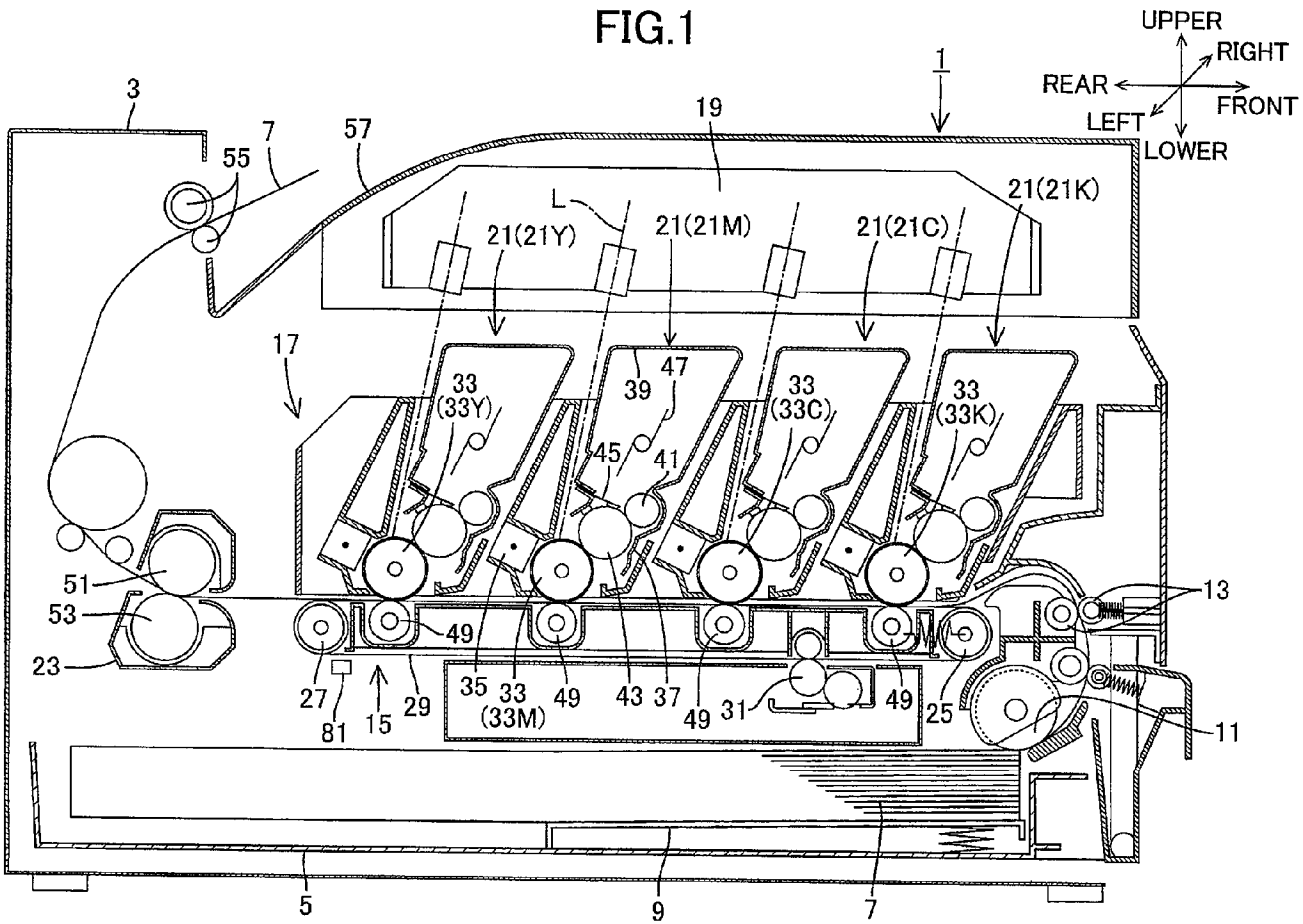
FIG. 1 is a side cross-sectional view showing the overall structure of a printer according to a preferred embodiment of the present invention.

FIG. 1 is a sectional side view illustrating a schematic configuration of a printer 1 according to the first embodiment. In the following description, the right side (rightward) of FIG. 1 is assumed to be the front side (forward) of the printer 1.

As shown in FIG. 1, the printer 1 is a tandem-electrophotographic direct-transferring color laser printer and is provided with a casing 3. A tray feeder 5 in which recoding medium (exemplified by paper sheets) 7 are stocked is disposed at the bottom of the casing 3.

The recording medium 7 is pressed against a pickup roller 11 by a pressing board 9, and is sent to a resist roller 13 by rotation of the pickup roller 11. The resist roller 13 corrects a skew of the recording medium 7 and then sends the recording medium 7 to a belt unit 15 at a predetermined timing.

An image forming unit 17 includes the belt unit 15, a scanner unit 19, process units 21, a fixing unit 23 and other elements.

The belt unit 15 includes an endless belt 29 provided between a pair of supporting rollers 25 and 27. The belt 29 is circularly rotated in the counter-clockwise direction in FIG. 1 by, for example, rotation of the rear supporting roller 27, so that a recording medium on the belt 29 is transferred to the rearward.

Further, a cleaning roller 31 is provided below the belt unit 15 in order to remove toner, such as a registration pattern 91 described below, paper dusts, and others adhered to the belt 29.

The scanner unit 19 includes a laser light emitting section (not shown) which is on/off-controlled based on image data, and irradiates a photosensitive drum of each color with laser beam L corresponding to an image of the color and concurrently makes high-speed scan.

Four process units 21 corresponding to the four colors of black, cyan, magenta, and yellow respectively are same in configuration except the colors of toner. Hereinafter, reference numbers 21 with corresponding subscripts of K (black), C (cyan), M (magenta) and Y (yellow) are used when it is necessary to discriminate the process units 21 in colors from one another, but the subscripts are to be omitted when no discrimination is needed.

Each process unit 21 includes a photosensitive drum 33, a charger 35, a developer cartridge 37, and other elements.

The developer cartridge 37 has a toner container 39, a supplying roller 41, a developing roller 43, and a layer thickness limiting blade 45.

Toner is supplied to the developing roller 43 by rotation of an agitator 47 and rotation of the supplying roller 41. The toner supplied to the surface of developing roller 43 enters a space between the layer thickness limiting blade 45 and the developing roller 43 to thereby be formed into a thin layer having a uniform thickness carried on the developing roller 43.

The surface of each photosensitive drum 33 is uniformly and positively charged by the charger 35, and then exposed by laser beam L from the scanner unit 19. Consequently, on the surface of the photosensitive drums 33, electrostatic latent images corresponding one to each of the colors are formed.

The toners born on the developing rollers 43 are supplied to electrostatic latent images formed on the surfaces of photosensitive drums 33, so that the electrostatic latent images become visible in the form of toner images, one in each of the corresponding colors.

While a recording medium 7 passes through each transferring position between the photosensitive drum 33 and a transferring roller 49 by the belt 29, a negative transferring bias is applied to the transferring roller 49. Thus, toner images born on the surface of the photosensitive drums 33 are transferred onto the recording medium 7. The recording medium 7 is then transferred to the fixing unit 23.

A heating roller 51 and a pressure roller 53 of the fixing unit 23 heats the recoding medium 7 holding the toner image thereon while transferring the recoding medium 7, so that the toner image is thermally fixed to the surface of the recording medium 7. Then, the recording medium 7 is discharged onto a discharging tray 57 by a discharging roller 55.

As shown in FIG. 1, the printer 1 is provided with a photosensor 81 disposed beneath the rear end of the conveying belt 29. The photosensor 81 is a reflective sensor provided with a light-emitting element and a light-receiving element. The light-emitting element irradiates light obliquely onto the surface of the conveying belt 29. The light-receiving element receives light reflected off the surface of the conveying belt 29 and outputs a binary signal indicating whether a mark 93 of a registration pattern 91 described later is present in the detection area.

(Electric Configuration of the Printer)

Figure 2:
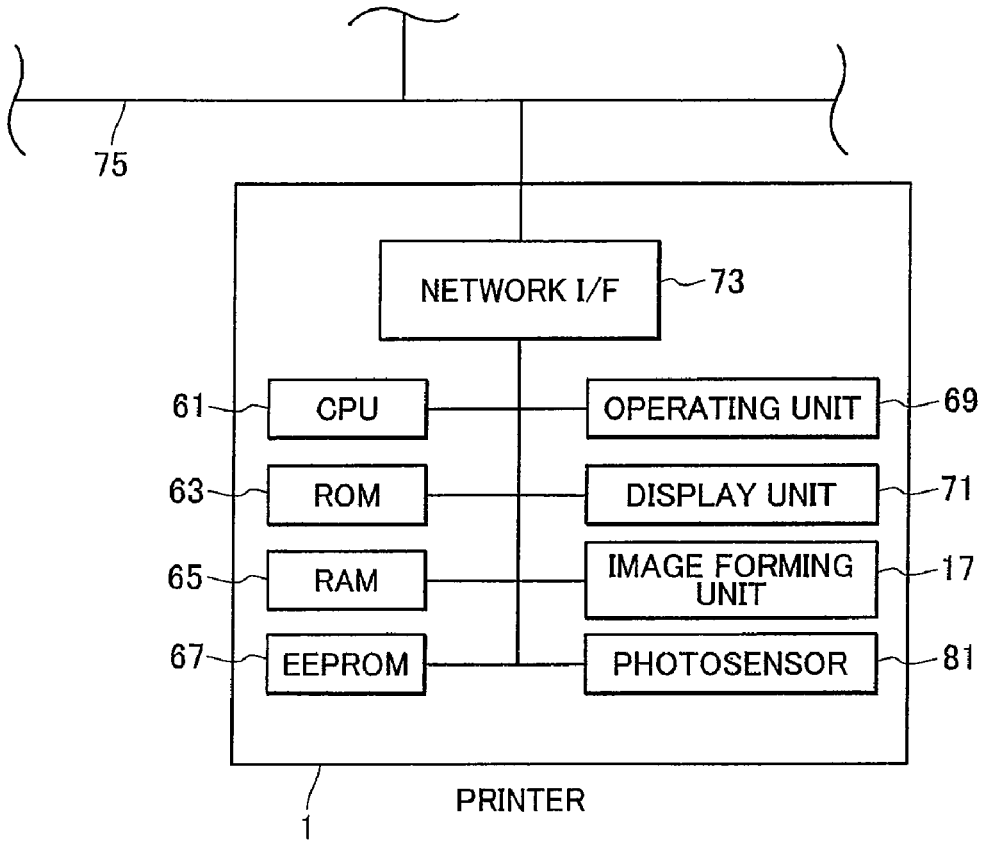
FIG. 2 is a block diagram showing the electrical structure of the printer.

FIG. 2 is a block diagram schematically showing the electrical configuration of the printer 1.

The printer 1 includes a CPU 61, a ROM 63, a RAM 65, an EEPROM (a non-volatile memory) 67, an operating unit 69, a display unit 71, the above-described image forming unit 17, a network interface 73, the optical sensor 81, and others.

The ROM 63 stores various programs for controlling operations of the printer 1. The CPU 61 controls operations of the printer 1 in accordance with programs read from the ROM 63, while storing the process results into the RAM 65 and/or the EEPROM 67.

The operating unit 69 has a plurality of buttons with which a user can perform various input operations, such as an instruction to start printing. The display unit 71 is formed by an LCD and lamps and can display various setting screen and an operation state thereon. The network interface 73 is connected to an external computer (not shown) through a communication line 75 and consequently makes mutual data communication possible.

(Process to Correct Position Deviation)

Figure 3:
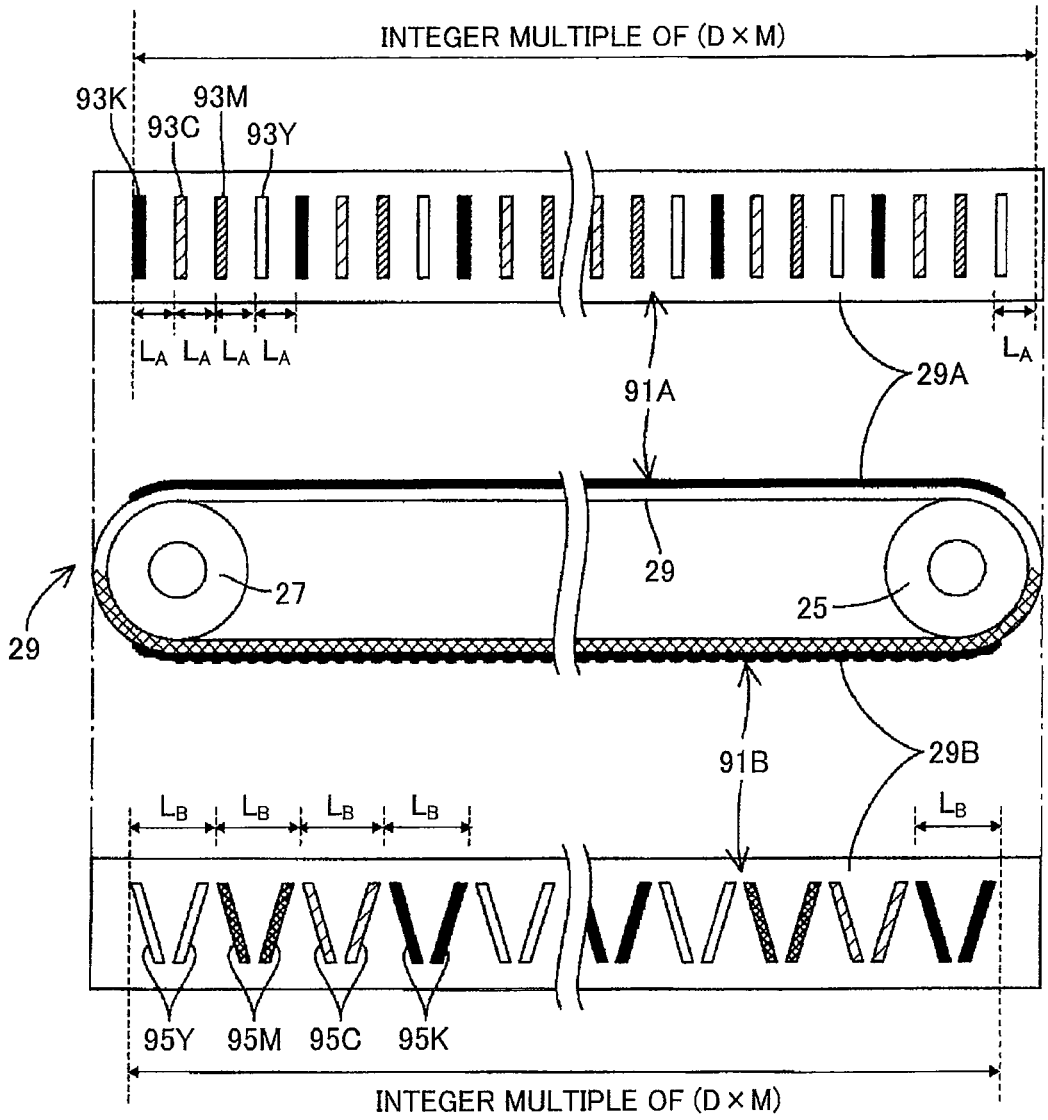
FIG. 3 is an explanatory diagram illustrating an example of a pattern formed on a conveying belt in the printer.

If image formation positions (transferring positions) on a recording medium are deviated from one another for each color, color images with color registration error is formed. In order to avoid such color registration error, a position calibrating process is performed. In this position calibrating process, black is set as a reference color (reference point) and the other colors (yellow, magenta, and cyan) are set as measurement colors, for example, and the photosensor 81 detects the image-forming position of each measurement color relative to the image-forming position of the reference color. From these detections, the CPU 61 derives the degree to which the image-forming position of each measurement color deviates from an ideal position and uses this deviation as a calibration amount to be reflected in subsequent image formation. More specifically, the CPU 61 executes a process well known in the art for calibrating the relative positions and reduction scale of each color by adjusting the exposure positions of laser beams L emitted from the scanning unit 19 based on the calibration amounts. FIG. 3 is an explanatory diagram showing an example of a pattern formed on the conveying belt 29 and includes, in order from top to bottom, a top view, side view, and bottom view of the conveying belt 29.

FIG. 3 shows a first registration pattern (hereinafter referred to as a "first pattern 91A") and a second registration pattern (hereinafter referred to as a "second pattern 91B"). The first pattern 91A is used for detecting offset of image-forming positions in the rotating direction of the conveying belt 29 (the front-to-rear direction of the printer 1; hereinafter referred to as a "subscanning direction"). More specifically, the first pattern 91A includes a plurality of bar-shaped marks 93 elongated in the left-to-right direction and juxtaposed along the conveying direction of the conveying belt 29. The plurality of marks 93 include a black mark 93K, a cyan mark 93C, a magenta mark 93M and a yellow mark 93Y arranged in the order given to form a group of marks. One or a plurality of these mark groups is juxtaposed in the subscanning direction. The marks are formed so that the distance between adjacent marks 93 (the distance between the leading edges of adjacent marks 93, for example) is LA.

The second pattern 91B is used for detecting offset of image-forming positions in a direction orthogonal to the subscanning direction (the left-to-right direction of the printer 1; hereinafter referred to as the "main scanning direction"). More specifically, the second pattern 91B includes a plurality of marks 95 juxtaposed along the conveying direction of the conveying belt 29, each mark 95 including a pair of bar-shaped marks set at different angles relative to the main scanning direction. One group of the marks 95 includes a black mark 95K, a cyan mark 95C, a magenta mark 95M and a yellow mark 95Y arranged in the order given, and one or a plurality of groups of marks is juxtaposed in the subscanning direction. The marks 95 are formed such that a distance between neighboring marks 95 (the distance between the trailing edges of the neighboring marks 95, for example) is LB. Data for the first pattern 91A and second pattern 91B is stored in the EEPROM 67, for example.

The CPU 61 executes the position calibrating process when a prescribed condition is met. Examples of this prescribed condition may be that the elapsed time or number of sheets of recording medium that have undergone image formation since the previous position calibrating process has reached a prescribed reference value. The process may also be executed when the user inputs a command to perform the process through the operating unit 69.

The image-forming unit 17 performs the following process at the beginning of the position calibrating process. As shown in FIG. 3, the image-forming unit 17 forms the first pattern 91A in a first region 29A constituting approximately half of the conveying belt 29 between the moment the operation begins and the moment the conveying belt 29 has completed half a circuit. Next, the image-forming unit 17 forms the second pattern 91B in a second region 29B constituting the approximate other half of the conveying belt 29 between the moment that the image-forming unit 17 completed formation of the first pattern 91A and the moment the conveying belt 29 has completed the second half of the circuit. Subsequently, the photosensor 81 detects the positions of each of the marks 93 and marks 95 in the first pattern 91A and second pattern 91B formed on the conveying belt 29, and the cleaning roller 31 cleans the conveying belt 29.

The photosensor 81 identifies the position of each mark 93 in the first pattern 91A and calculates the average distance for each color from a point of origin (a virtual position). When forming the marks 93 in the first pattern 91A shown in FIG. 3, the black mark 93K, cyan mark 93C, magenta mark 93M and yellow mark 93Y are ideally spaced at intervals LA. When the marks deviate from these ideal positions, the distances from the black mark 93K to the marks 93 of other colors are no longer integer multiples of LA.

Hence, the ideal positional relationships between colors are an average differential of LA between the black mark 93K and cyan mark 93C, an average differential of 2LA between the black mark 93K and magenta mark 93M, and an average differential of 3LA between the black mark 93K and yellow mark 93Y. The CPU 61 derives calibration amounts based on deviations from these ideal positional relationships, stores these amounts in the EEPROM 67, and calibrates image-forming positions for each color in the subscanning direction by referencing the calibration amounts in subsequent image-forming operations.

Here, average distances from the point of origin are calculated for each color because the effects of error in detecting the positions of the marks 93 due to noise or the like are greater when the position of each colored mark 93 is determined based on a single measurement result. Therefore, it is preferable to average a plurality of results in order to detect the positions of the marks 93 more reliably.

The same process is executed for the second pattern 91B formed on the conveying belt 29. Specifically, the photosensor 81 identifies the position of each mark 95 in the second pattern 91B and calculates the average distance from the point of origin for each color. In the case of the second pattern 91B, the black mark 95K, cyan mark 95C, magenta mark 95M, and yellow mark 95Y are ideally spaced at intervals of LB. When the positions of these marks deviate from their ideal positions, the distance from the black mark 95K to the marks 95 of other colors is no longer an integer multiple of LB.

Specifically, the ideal positional relationships of the colors include an average differential of LB between the black mark 95K and cyan mark 95C, an average differential of 2LB between the black mark 95K and magenta mark 95M, and an average differential of 3LB between the black mark 95K and yellow mark 95Y. The CPU 61 derives calibration amounts based on the amount of deviation from the ideal positional relationships, stores these amounts in the EEPROM 67, and adjusts image-forming positions of each color in the main scanning direction by referencing these calibration amounts in subsequent image-forming operations.

Here, the average distance from the point of origin is calculated for each color because the effects of error in detecting the positions of the marks due to noise and the like are greater when the position of the marks 95 in each color is determined based on a single measurement result. Accordingly, it is preferable to average a plurality of results in order to detect the positions of the marks 95 more reliably.

Next, the first pattern 91A of marks 93 will be described in greater detail with reference to FIG. 4. Since the second pattern 91B of marks 95 is formed based on the same concept, merely substituting the mark interval LB of the marks 95 for the mark interval LA of the marks 93 in the following description, only the first pattern 91A of marks 93 will be described below.

Figure 4:
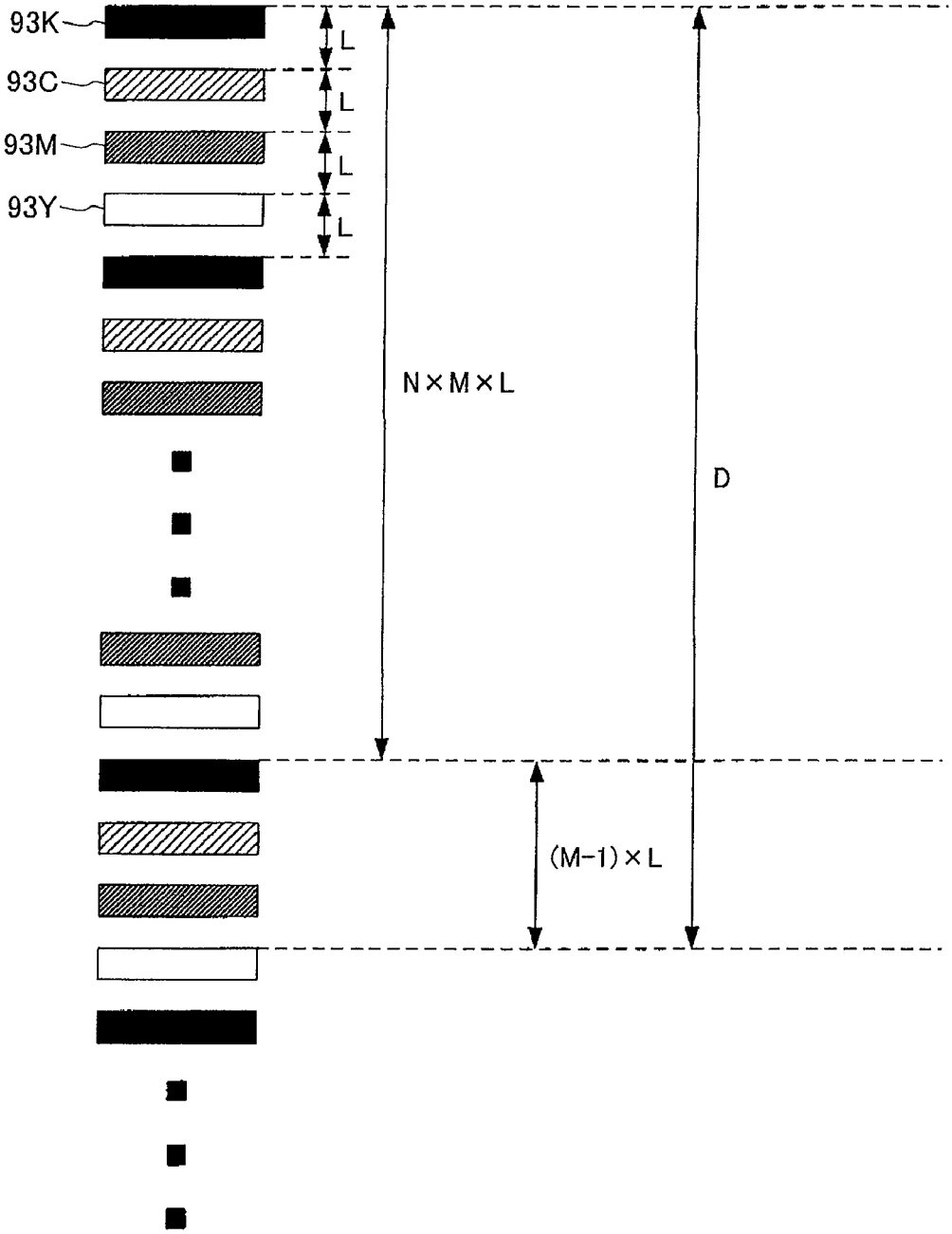
FIG. 4 is an explanatory diagram showing a first pattern of marks according to a first embodiment.

As shown in FIG. 4, the first pattern 91A is configured of one or a plurality of groups of marks juxtaposed in the subscanning direction, each group including the black mark 93K, cyan mark 93C, magenta mark 93M and yellow mark 93Y in the order given. The marks 93 are formed so that equation (1) below is satisfied, where D is the circumference of the photosensitive drum 33, L is the distance between neighboring marks, M is the number of colors, and N is an integer no less than 0 denoting the number of groups of marks.

$$D=N\times M\times L+(M-1)\times L \quad (1)$$

Since the printer 1 according to the preferred embodiment uses the four colors black, cyan, magenta, and yellow, the number 4 is substituted for M in equation (1). Further, since the distance between neighboring marks is LA, LA is substituted for L in equation (1). An arbitrary integer of 0 or greater may be selected for N. In the following example, the value 1 will be substituted for N. However, while the following description is for four colors (M=4) and one group of marks (N=1), similar results can be obtained when setting different quantities.

Using the above values, equation (1) becomes D=7LA. In the preferred embodiment, the marks 93 are formed to satisfy this condition. Accordingly, seven marks 93 are formed on the conveying belt 29 in the order of colors at intervals LA and within the circumference D. In other words, the image-forming unit 17 forms one group (N groups; no groups are formed if N=0) of marks including one mark 93 in each of the four colors, followed by marks 93 in each of three colors (M−1) on the conveying belt 29 within the circumference D.

However, sometimes foreign matter, scratches, or the like on the photosensitive drum 33 can produce unintended images, such as black marks or other blemishes, in non-image-forming positions every rotational period of the photosensitive drum 33. Depending on their positions, the blemishes may overlap part of the marks 93, modifying the outline (shape) of the marks 93. Consequently, the photosensor 81 may misinterpret the blemish as the mark 93 when detecting the position of a mark 93 overlapped by a blemish, degrading the accuracy for detecting positions of the marks 93. When these adverse effects are concentrated on marks 93 of a specific color, the position detecting accuracy for marks of this color becomes much worse than marks of other colors not affected by such misinterpretation, preventing suitable calibration of registration error.

To compensate for this, the printer 1 according to the preferred embodiment forms the marks 93 so as to satisfy the condition of equation (1) described above, as in the example D=7LA. By satisfying this condition, even when blemishes (unintended black toner images formed in non-image-forming positions) on the photosensitive drum 33K for forming black toner images produced every rotational period of the photosensitive drum 33K overlap part of the marks 93, for example, one blemish overlaps a mark 93 of a different color than subsequent blemishes, preventing the adverse effects of the blemishes from being concentrated on marks 93 of only a specific color.

For example, when the condition D=7LA is met, seven marks 93 are formed in the order of colors at intervals LA within the circumference D of the conveying belt 29. If the mark 93 in the leading position of this range is black, for example, then the seven marks 93 formed in order from this leading position within the circumferential range are black, cyan, magenta, yellow, black, cyan, and magenta.

Here, we will assume that a blemish is generated on the photosensitive drum 33K used for forming black toner images, and the blemish partially overlaps the black mark 93K in the leading position. In this case, while the blemish is formed on the conveying belt 29 at intervals equivalent to the circumference D of the photosensitive drum 33, the mark 93 formed at a position a distance D from the starting point of the black mark 93K is the yellow mark 93Y, which is the leading mark of a second region equivalent to the circumference D and following the first region. Therefore, the next blemish is formed over the yellow mark 93Y rather than the black mark 93K.

Similarly, the next blemish is formed over the magenta mark 93M and the following blemish over the cyan mark 93C. The blemish formed after the cyan mark 93C again overlaps the black mark 93K.

Hence, when forming marks 93 so as to satisfy equation (1) described above, the colors of the marks 93 positioned at distances from the initial mark 93 equivalent to integral multiples of the circumference D of the photosensitive drum 33 shift orderly among each of the colors used in image formation. In the example described above, the color of these marks 93 changes in the cycle black, yellow, magenta, cyan, and black.

Therefore, in the event that a blemish is formed at a position overlapping the marks 93, this configuration can prevent the adverse effects of the blemish from being concentrated on only one specific color. In other words, the present invention can prevent a dramatic decrease in precision for calibrating registration error caused by such blemishes.

When the adverse effects described above are equivalent among each color of the marks 93, the decline in calibrating precision caused by blemishes can be further reduced. This is because an equivalent amount of error (adverse effects) is produced among each color since the amount of registration error is found based on the relative distance between marks 93 of each color and, hence, this error can be canceled when calculating the relative distances (differences between detected positions). The adverse effects can be evenly divided among each color of the marks 93 as described above by forming the first pattern 91A of marks 93 so that the overall length of the first pattern 91A (the distance obtained by adding the interval LA between marks 93 to the distance between the initial mark 93 and the final mark 93) is an integer multiple of D×M, as shown in FIG. 3, where D is the circumference of the photosensitive drum 33 and M is the number of colors used in image formation. In other words, the number of marks 93 constituting the first pattern 91A can be set to the product of the number of colors M and the number of marks 93 formed within the distance D.

Second Embodiment

Figure 5:
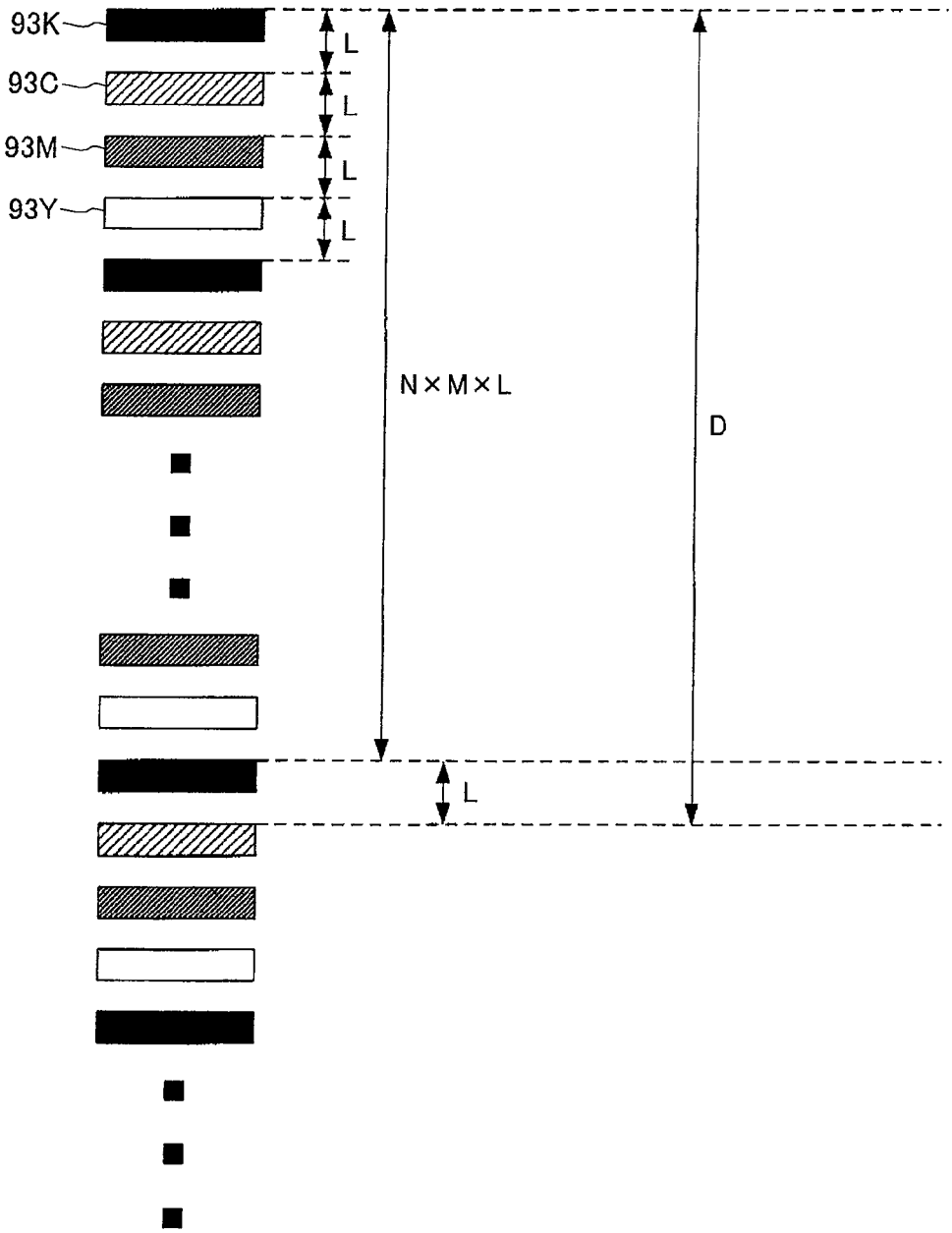
FIG. 5 is an explanatory diagram showing a first pattern of marks according to a second embodiment.

FIG. 5 shows the first pattern 91A according to a second embodiment of the present invention. The second embodiment differs from the first embodiment only in the first pattern 91A of marks 93 and is identical to the first embodiment otherwise. Therefore, like parts and components are designated with the same reference numerals to avoid duplicating description.

As shown in FIG. 5, the marks 93 of the first pattern 91A are formed to satisfy equation (2) below, where D is the circumference of the photosensitive drum 33, L is the distance between neighboring marks, M is the number of colors used for image formation, and N is an integer no less than 0 indicating the number of groups of marks to be formed.

$$D=N\times M\times L+L \tag{2}$$

Since the printer 1 according to the preferred embodiment uses the four colors black, cyan, magenta, and yellow, the number 4 is substituted for M in equation (2). Further, since the distance between neighboring marks is LA, LA is substituted for L in equation (2). An arbitrary integer of 0 or greater may be selected for N. In the following example, the value 1 will be substituted for N. However, while the following description is for four colors (M=4) and one group of marks (N=1), similar results can be obtained when setting different quantities.

Using the above values, equation (2) becomes D=5LA. In the preferred embodiment, the marks 93 are formed to satisfy this condition. Accordingly, five marks 93 are formed on the conveying belt 29 in the order of colors at intervals LA and within the circumference D. In other words, the image-forming unit 17 forms one group (N groups; no groups are formed if N=0) of marks including one mark 93 in each of the four colors, followed by a mark 93 in one color on the conveying belt 29 within the circumference D.

When the condition D=5LA is met, five marks 93 are formed in the order of colors at intervals LA within the circumference D of the conveying belt 29. If the mark 93 in the leading position of this range is black, for example, then the five marks 93 formed in order from this leading position within the circumferential range are black, cyan, magenta, yellow, and black.

Here, we will assume that a blemish is generated on the photosensitive drum 33K used for forming black toner images, and the blemish partially overlaps the black mark 93K in the leading position. In this case, while the blemish is formed on the conveying belt 29 at intervals equivalent to the circumference D of the photosensitive drum 33, the mark 93 formed at a position a distance D from the starting point of the black mark 93K is the cyan mark 93C, which is the leading mark of a second region equivalent to the circumference D and following the first region. Therefore, the next blemish is formed over the cyan mark 93C rather than the black mark 93K.

Similarly, the next blemish is formed over the magenta mark 93M and the following blemish over the yellow mark 93Y. The blemish formed after the yellow mark 93Y again overlaps the black mark 93K.

Hence, when forming marks 93 so as to satisfy equation (2) described above, the colors of the marks 93 positioned at distances from the initial mark 93 equivalent to integral multiples of the circumference D of the photosensitive drum 33 shift orderly among each of the colors used in image formation. In the example described above, the color of these marks 93 changes in the cycle black, cyan, magenta, yellow, and black.

Therefore, in the event that a blemish is formed at a position overlapping the marks 93, this configuration can prevent the adverse effects of the blemish from being concentrated on only one specific color. In other words, the present invention can prevent a dramatic decrease in precision for calibrating registration error caused by such blemishes.

Third Embodiment

Figure 6:
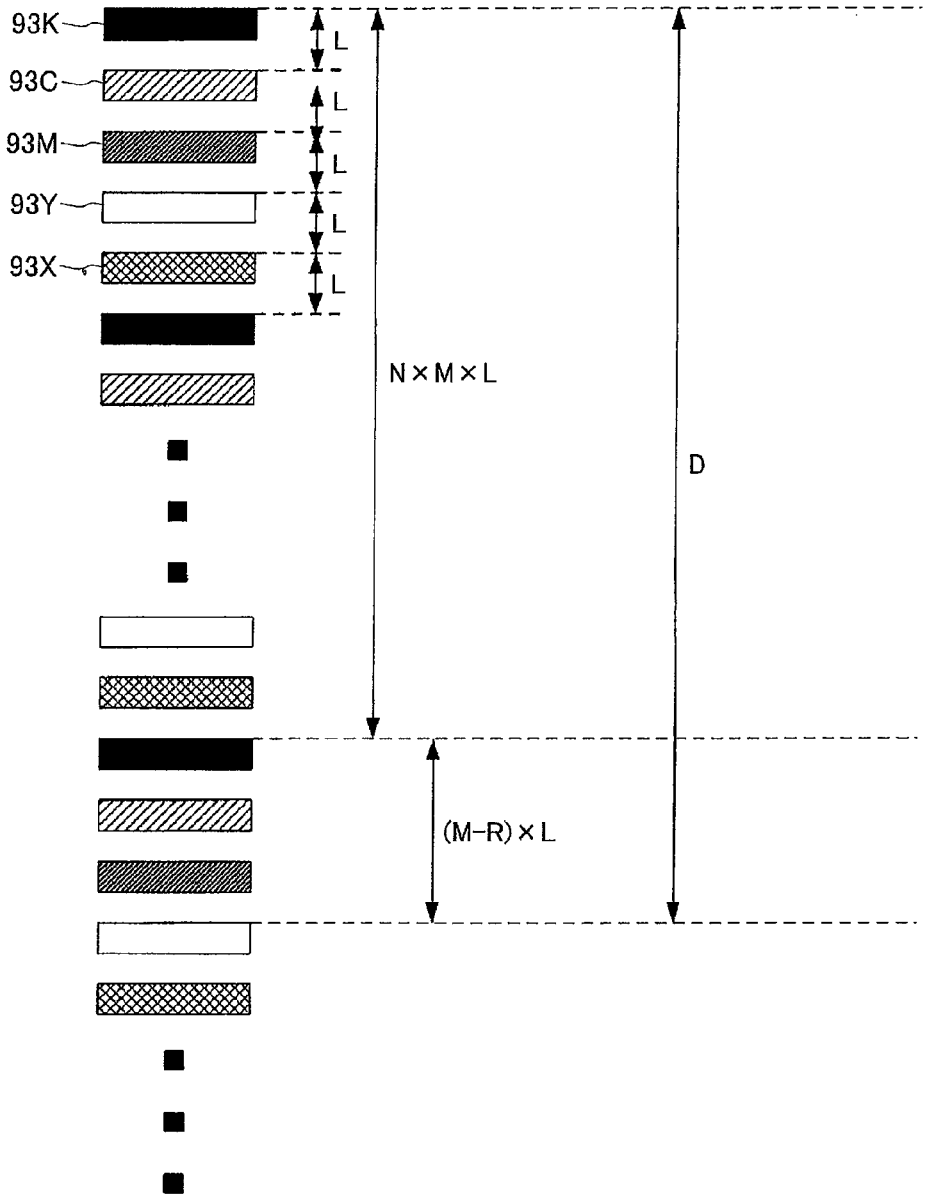
FIG. 6 is an explanatory diagram showing a first pattern of marks according to a third embodiment.

FIG. 6 shows the first pattern 91A according to a third embodiment of the present invention. The third embodiment differs from the first embodiment only in the first pattern 91A of marks 93 and is identical to the first embodiment otherwise. Therefore, like parts and components are designated with the same reference numerals to avoid duplicating description. However, the third embodiment is an example in which the printer 1 uses five colors for image formation. Therefore, an extra process unit 21 corresponding to the additional color must be juxtaposed together with the four process units 21 shown in FIG. 1. The mark 93 corresponding to the additional color is indicated in FIG. 6 as a mark 93X.

As shown in FIG. 6, the marks 93 of the first pattern 91A are formed to satisfy equation (3) below, where D is the circumference of the photosensitive drum 33, L is the distance between neighboring marks, M is the number of colors used for image formation (where M≧5), N is an integer no less than 0 indicating the number of groups of marks to be formed, and R is a positive integer (where M>2R, M≠IR (I is an integer)).

$$D=N\times M\times L+(M-R)\times L \tag{3}$$

Since the printer 1 according to the preferred embodiment uses the five colors black, cyan, magenta, yellow, and an "additional color," the number 5 is substituted for M in equation (3). Further, since the distance between neighboring marks is LA, LA is substituted for L in equation (3). An arbitrary integer of 0 or greater may be selected for N. In the following example, the value 1 will be substituted for N. Further, R is a positive integer selected arbitrarily to satisfy expressions M>2R and M≠IR (where I is an integer). In the following example, 2 is substituted for R. Further, while the following description is described for five colors (M=5), one group of marks (N=1), and the positive integer 2 (R=2), similar results can be obtained when setting different quantities.

Using the above values, equation (3) becomes D=8LA. In the preferred embodiment, the marks 93 are formed to satisfy this condition. Accordingly, eight marks 93 are formed on the conveying belt 29 in the order of colors at intervals LA and within the circumference D. In other words, the image-forming unit 17 forms one group (N groups; no groups are formed if N=0) of marks including one mark 93 in each of the five colors, followed by marks 93 in three colors (M−R) on the conveying belt 29 within the circumference D.

When the condition D=8LA is met, eight marks 93 are formed in the order of colors at intervals LA within the circumference D of the conveying belt 29. If the mark 93 in the leading position of this range is black, for example, then the eight marks 93 formed in order from this leading position within the circumferential range are black, cyan, magenta, yellow, "additional color," black, cyan, and magenta.

Here, we will assume that a blemish is generated on the photosensitive drum 33K used for forming black toner images, and the blemish partially overlaps the black mark 93K in the leading position. In this case, while the blemish is formed on the conveying belt 29 at intervals equivalent to the circumference D of the photosensitive drum 33, the mark 93 formed at a position a distance D from the starting point of the black mark 93K is the yellow mark 93Y, which is the leading mark of a second region equivalent to the circumference D and following the first region. Therefore, the next blemish is formed over the yellow mark 93Y rather than the black mark 93K.

Similarly, the next blemish is formed over the cyan mark 93C, the subsequent blemish over the mark 93X in the "additional color," and the following blemish over the magenta mark 93M. The blemish formed after the magenta mark 93M again overlaps the black mark 93K.

Hence, when forming marks 93 so as to satisfy equation (3) described above, the colors of the marks 93 positioned at distances from the initial mark 93 equivalent to integral multiples of the circumference D of the photosensitive drum 33 shift orderly among each of the colors used in image formation. In the example described above, the color of these marks 93 changes in the cycle black, yellow, cyan, "additional color," magenta, and black.

Therefore, in the event that a blemish is formed at a position overlapping the marks 93, this configuration can prevent the adverse effects of the blemish from being concentrated on only one specific color. In other words, the present invention can prevent a dramatic decrease in precision for calibrating registration error caused by such blemishes.

Fourth Embodiment

Figure 7:
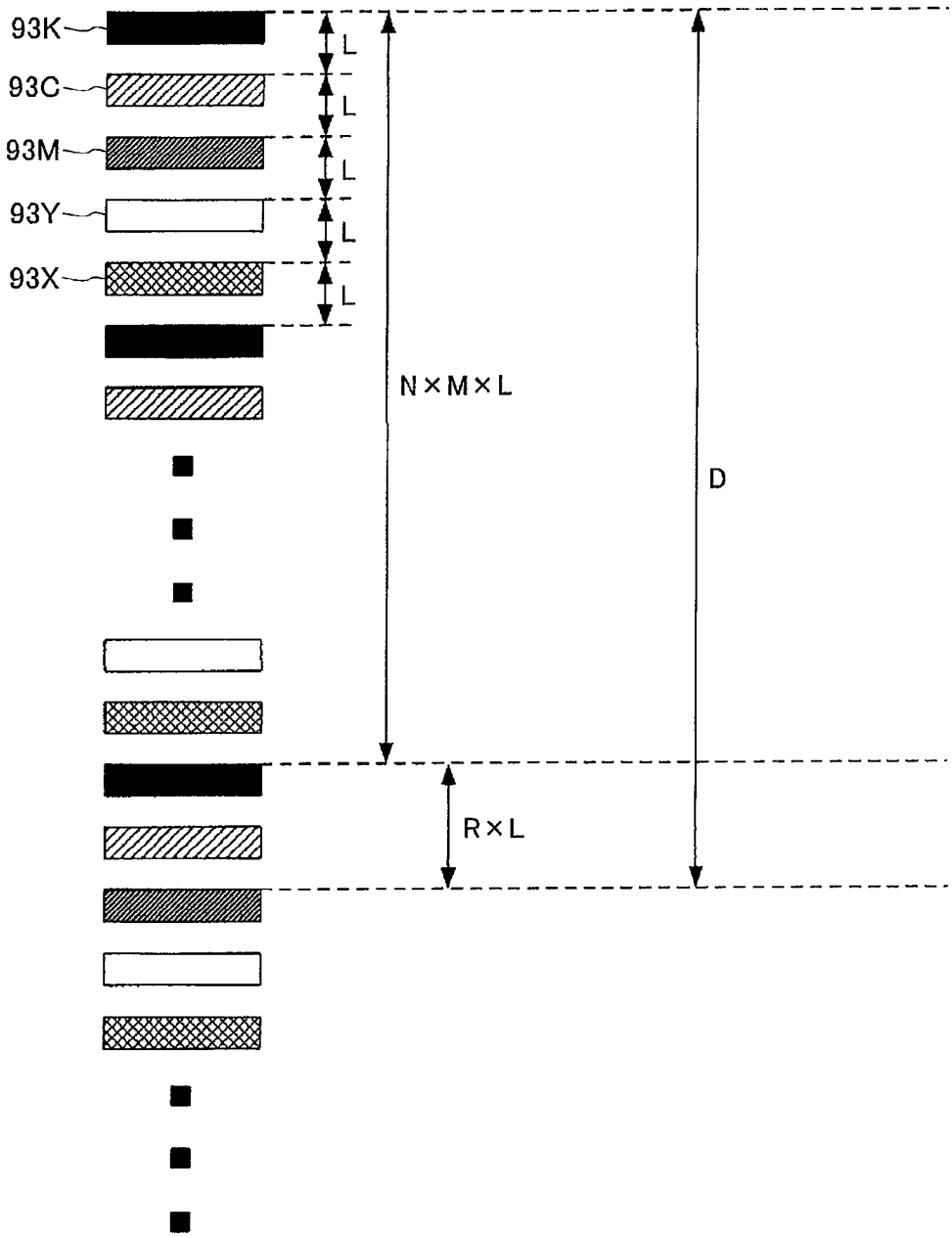
FIG. 7 is an explanatory diagram showing a first pattern of marks according to a fourth embodiment.

FIG. 7 shows the first pattern 91A according to a fourth embodiment of the present invention. The fourth embodiment differs from the first embodiment only in the first pattern 91A of marks 93 and is identical to the first embodiment otherwise. Therefore, like parts and components are designated with the same reference numerals to avoid duplicating description. However, the fourth embodiment is an example in which the printer 1 uses five colors for image formation. Therefore, an extra process unit 21 corresponding to the additional color must be juxtaposed together with the four process units 21 shown in FIG. 1. The mark 93 corresponding to the additional color is indicated in FIG. 7 as a mark 93X.

As shown in FIG. 7, the marks 93 of the first pattern 91A are formed to satisfy equation (4) below, where D is the circumference of the photosensitive drum 33, L is the distance between neighboring marks, M is the number of colors used for image formation (where M>5), N is an integer no less than 0 indicating the number of groups of marks to be formed, and R is a positive integer (where M>2R, M≠IR (I is an integer)).

$$D=N\times M\times L+R\times L \tag{4}$$

Since the printer 1 according to the preferred embodiment uses the five colors black, cyan, magenta, yellow, and an "additional color," the number 5 is substituted for M in equation (4). Further, since the distance between neighboring marks is LA, LA is substituted for L in equation (4). An arbitrary integer of 0 or greater may be selected for N. In the following example, the value 1 will be substituted for N. Further, R is a positive integer selected arbitrarily to satisfy expressions M>2R and M≠IR (where I is an integer) In the following example, 2 is substituted for R. Further, while the following description is described for five colors (M=5), one group of marks (N=1), and the positive integer 2 (R=2), similar results can be obtained when setting different quantities.

Using the above values, equation (4) becomes D=7LA. In the preferred embodiment, the marks 93 are formed to satisfy this condition. Accordingly, seven marks 93 are formed on the conveying belt 29 in the order of colors at intervals LA and within the circumference D. In other words, the image-forming unit 17 forms one group (N groups; no groups are formed if N=0) of marks including one mark 93 in each of the five colors, followed by marks 93 in two colors (R) on the conveying belt 29 within the circumference D.

When the condition D=7LA is met, seven marks 93 are formed in the order of colors at intervals LA within the circumference D of the conveying belt 29. If the mark 93 in the leading position of this range is black, for example, then the seven marks 93 formed in order from this leading position within the circumferential range are black, cyan, magenta, yellow, "additional color," black, and cyan.

Here, we will assume that a blemish is generated on the photosensitive drum 33K used for forming black toner images, and the blemish partially overlaps the black mark 93K in the leading position. In this case, while the blemish is formed on the conveying belt 29 at intervals equivalent to the circumference D of the photosensitive drum 33, the mark 93 formed at a position a distance D from the starting point of the black mark 93K is the magenta mark 93M, which is the leading mark of a second region equivalent to the circumference D and following the first region. Therefore, the next blemish is formed over the magenta mark 93M rather than the black mark 93K.

Similarly, the next blemish is formed over the mark 93X in the "additional color," the subsequent blemish over the cyan mark 93C, and the following blemish over the yellow mark 93Y. The blemish formed after the yellow mark 93Y again overlaps the black mark 93K.

Hence, when forming marks 93 so as to satisfy equation (4) described above, the colors of the marks 93 positioned at distances from the initial mark 93 equivalent to integral multiples of the circumference D of the photosensitive drum 33 shift orderly among each of the colors used in image formation. In the example described above, the color of these marks 93 changes in the cycle black, magenta, "additional color," cyan, yellow, and black.

Therefore, in the event that a blemish is formed at a position overlapping the marks 93, this configuration can prevent the adverse effects of the blemish from being concentrated on only one specific color. In other words, the present invention can prevent a dramatic decrease in precision for calibrating registration error caused by such blemishes.

Other Embodiments

While the invention has been described in detail with reference to the specific embodiment thereof, it would be apparent to those skilled in the art that various changes and modifications may be made therein without departing from the spirit of the invention.

(1) The image-forming device according to the preferred embodiments described above is a direct tandem type color laser printer that superimposes toner images in a plurality of colors on a recording medium 7. However, the present invention may be applied to an intermediate transfer type color laser printer that superimposes toner images in a plurality of colors on an intermediate transfer belt. In this case, the intermediate transfer belt functions as the image-carrying member of the present invention.

(2) Further, the formation order of the marks 93 and 95 and the juxtaposed order of the process units 21 are not limited to the examples in the preferred embodiment described above. These orders, as well as the number of colors used in the image-forming device may be modified from the orders and numbers described in the preferred embodiments.

What is claimed is:

1. An image-forming device comprising:

a plurality of photosensitive drums arrayed in numeric order in a first direction, each of the photosensitive drums being rotatable and having a circumferential length D, a number of the plurality of photosensitive drums represented by M;

a forming unit configured to form a registration mark on each of the photosensitive drums, each of the registration marks formed on each of the photosensitive drums having a color different from one another;

an image-carrying member extending in the first direction, the registration marks formed on the photosensitive drums being transferred onto the image-carrying member in the numeric order, the registration marks transferred onto the image-carrying member being arrayed in the first direction, wherein neighboring registration marks are spaced by a distance L in the first direction;

a detecting unit configured to detect positions of the registration marks transferred onto the image-carrying member; and a calibrating unit configured to calibrate positions of the photosensitive drums at which the forming unit forms the registration marks, based on the positions detected by the detecting unit, wherein $D=N\times M\times L+(M-1)\times L$, N being an integer no less than 0.

2. The image-forming device according to claim 1, wherein the forming unit forms the registration marks so that an overall length of the registration marks transferred to the image-carrying member is an integer multiple of $D\times M$.

3. An image-forming device comprising:

a plurality of photosensitive drums arrayed in numeric order in a first direction, each of the photosensitive drums being rotatable and having a circumferential length D, a number of the plurality of photosensitive drums represented by M;

a forming unit configured to form a registration mark on each of the photosensitive drums, each of the registration marks formed on each of the photosensitive drums having a color different from one another;

an image-carrying member extending in the first direction, the registration marks formed on the photosensitive drums being transferred onto the image-carrying member in the numeric order, the registration marks transferred onto the image-carrying member being arrayed in the first direction, wherein neighboring registration marks are spaced by a distance L in the first direction;

a detecting unit configured to detect positions of the registration marks transferred onto the image-carrying member; and a calibrating unit configured to calibrate positions of the photosensitive drums at which the forming unit forms the registration marks, based on the positions detected by the detecting unit, wherein $D=N\times M\times L+L$, N being an integer no less than 0.

4. The image-forming device according to claim 3, wherein the forming unit forms the registration marks so that an overall length of the registration marks transferred to the image-carrying member is an integer multiple of $D\times M$.

5. An image-forming device comprising:

1st to Mth photosensitive drums arrayed in numeric order in a first direction, each of the photosensitive drums being rotatable and having a circumferential length D, M being an integer no less than 4;

a forming unit configured to form a registration mark on each of the photosensitive drums, each of the registration marks formed on each of the photosensitive drums having a color different from one another;

an image-carrying member extending in the first direction, the registration marks formed on the photosensitive drums being transferred onto the image-carrying member in the numeric order, the registration marks transferred onto the image-carrying member being arrayed in the first direction, wherein neighboring registration marks are spaced by a distance L in the first direction;

a detecting unit configured to detect positions of the registration marks transferred onto the image-carrying member; and a calibrating unit configured to calibrate positions of the photosensitive drums at which the forming unit forms the registration marks, based on the positions detected by the detecting unit, wherein $D=N\times M\times L+(M-R)\times L$, N being an integer no less than 0, R being a positive integer (such that $M>2R$ and $M\neq R$ (where I is an integer)).

6. The image-forming device according to claim 5, wherein the forming unit forms the registration marks so that an overall length of the registration marks transferred to the image-carrying member is an integer multiple of $D\times M$.

7. An image-forming device comprising:

1st to Mth photosensitive drums arrayed in numeric order in a first direction, each of the photosensitive drums being rotatable and having a circumferential length D, M being an integer no less than 4;

a forming unit configured to form a registration mark on each of the photosensitive drums, each of the registration marks formed on each of the photosensitive drums having a color different from one another;

an image-carrying member extending in the first direction, the registration marks formed on the photosensitive drums being transferred onto the image-carrying member in the numeric order, the registration marks transferred onto the image-carrying member being arrayed in the first direction, wherein neighboring registration marks are spaced by a distance L in the first direction;

a detecting unit configured to detect positions of the registration marks transferred onto the image-carrying member; and a calibrating unit configured to calibrate positions of the photosensitive drums at which the forming unit forms the registration marks, based on the positions detected by the detecting unit, wherein $D=N\times M\times L+R\times L$, N being an integer no less than 0, R being a positive integer (such that $M>2R$ and $M\neq IR$ (where I is an integer)).

8. The image-forming device according to claim 7, wherein the forming unit forms the registration marks so that an overall length of the registration marks transferred to the image-carrying member is an integer multiple of $D\times M$.

* * * * *